US007214411B2

(12) United States Patent
Colbert et al.

(10) Patent No.: US 7,214,411 B2
(45) Date of Patent: May 8, 2007

(54) COATING SPRAY APPARATUS AND METHOD OF USING SAME

(75) Inventors: Elizabeth A. Colbert, Newark, DE (US); Andrew B. Bingaman, Dillsburg, PA (US); Scott E. Statler, Yorktown Heights, NY (US); Michael J. Budroe, Orange Park, FL (US); Walter Weldon, Gainesville, VA (US)

(73) Assignee: Lafarge Platres, Avignon Cedex (FR)

( * ) Notice: Subject to any disclaimer, the term of this patent is extended or adjusted under 35 U.S.C. 154(b) by 0 days.

(21) Appl. No.: 10/822,783

(22) Filed: Apr. 13, 2004

(65) Prior Publication Data

US 2005/0227013 A1 Oct. 13, 2005

(51) Int. Cl.
*B05D 5/00* (2006.01)

(52) U.S. Cl. ..... 427/421.1; 427/424; 427/427.3; 118/313; 118/314; 118/323

(58) Field of Classification Search ..... 427/427.3, 427/421.1, 424; 118/313, 314, 3
See application file for complete search history.

(56) References Cited

U.S. PATENT DOCUMENTS

| | | | |
|---|---|---|---|
| 1,439,289 | A | 12/1922 | Buttress |
| 1,993,472 | A | 3/1935 | Borsari-Fischer |
| 2,109,719 | A | 3/1938 | Brusse |
| 2,205,423 | A | 6/1940 | Lefubre |
| 2,754,795 | A | 7/1956 | Enssle |
| 2,770,216 | A | 11/1956 | Schock |
| 2,833,139 | A | 5/1958 | Bosshard |
| 2,925,631 | A | 2/1960 | Larson et al. |
| 3,003,979 | A | 10/1961 | Ptasienski et al. |
| 3,043,014 | A | 7/1962 | Loechl |
| 3,180,058 | A | 4/1965 | Tillisch et al. |
| 3,256,223 | A | 6/1966 | Heijmer |
| 3,284,980 | A | 11/1966 | Dinkel |
| 3,382,119 | A | 5/1968 | Henkel |

(Continued)

FOREIGN PATENT DOCUMENTS

| | | |
|---|---|---|
| AU | 19322/92 | 1/1993 |

(Continued)

OTHER PUBLICATIONS

"ACUMER® 9400—Dispersant for Paper and Paperboard Coatings", Rohm and Haas Company, Special Polymers.

(Continued)

*Primary Examiner*—Alain L. Bashore
(74) *Attorney, Agent, or Firm*—Buchanan Ingersoll & Rooney, PC

(57) ABSTRACT

A manufacturing line for gypsum boards includes a conveyor for moving gypsum boards in a line; a spray arm having a pivot at one end thereof for supporting the spray arm in a pivotable manner; a base frame mounted adjacent the conveyor; a support for the pivot mounted on the base frame so that the spray arm can be pivoted from an operative position wherein the spray arm extends over the conveyor to an inoperative position; a plurality of spray nozzles arranged on the spray arm for spraying a coating on gypsum boards on the conveyor; and a pump system on the frame to deliver the coating to the plurality of spray nozzles.

28 Claims, 7 Drawing Sheets

U.S. PATENT DOCUMENTS

| | | | | |
|---|---|---|---|---|
| 3,411,926 | A | | 11/1968 | Gogek et al. |
| 3,422,587 | A | | 1/1969 | Murray |
| 3,576,091 | A | | 4/1971 | Shull, Jr. et al. |
| 3,708,935 | A | | 1/1973 | Kossuth et al. |
| 3,819,395 | A | | 6/1974 | Yocum |
| 3,835,074 | A | | 9/1974 | Desmarais |
| 3,907,725 | A | | 9/1975 | Forte et al. |
| 3,975,320 | A | | 8/1976 | Lane et al. |
| 3,984,596 | A | | 10/1976 | Failmezger |
| 4,117,183 | A | | 9/1978 | Long |
| 4,205,041 | A | | 5/1980 | Hymes |
| 4,287,103 | A | | 9/1981 | Francis et al. |
| 4,294,622 | A | | 10/1981 | Brown |
| 4,386,112 | A | * | 5/1983 | Eaton et al. ..... 427/446 |
| 4,454,267 | A | | 6/1984 | Williams |
| 4,558,079 | A | | 12/1985 | Desmarais |
| 4,579,610 | A | | 4/1986 | Kole et al. |
| 4,657,594 | A | | 4/1987 | Struss |
| 4,661,164 | A | | 4/1987 | Severinghaus, Jr. et al. |
| 4,672,787 | A | | 6/1987 | Murphy |
| 4,686,253 | A | | 8/1987 | Struss et al. |
| 4,725,477 | A | | 2/1988 | Kole et al. |
| 4,743,475 | A | | 5/1988 | Negri et al. |
| 4,820,754 | A | | 4/1989 | Negri et al. |
| 4,845,152 | A | | 7/1989 | Palmer |
| 4,959,272 | A | | 9/1990 | Long |
| 4,965,031 | A | | 10/1990 | Conroy |
| 4,988,543 | A | | 1/1991 | Houle et al. |
| 4,995,333 | A | * | 2/1991 | Keller et al. ..... 118/300 |
| 5,019,195 | A | | 5/1991 | Skinner |
| 5,055,323 | A | | 10/1991 | Kole et al. |
| 5,088,260 | A | | 2/1992 | Barton et al. |
| 5,102,462 | A | | 4/1992 | Podlas |
| 5,143,757 | A | | 9/1992 | Skinner |
| 5,207,830 | A | | 5/1993 | Cowan et al. |
| 5,230,200 | A | | 7/1993 | Douglas et al. |
| 5,258,069 | A | | 11/1993 | Knechtel et al. |
| 5,334,243 | A | | 8/1994 | Hyman |
| 5,336,318 | A | | 8/1994 | Attard et al. |
| 5,487,250 | A | | 1/1996 | Yount et al. |
| 5,714,032 | A | | 2/1998 | Ainsley et al. |
| 5,746,822 | A | | 5/1998 | Espinoza et al. |
| 5,908,521 | A | | 6/1999 | Ainsley et al. |
| 5,922,447 | A | | 7/1999 | Baig |
| 5,945,198 | A | | 8/1999 | Deodhar et al. |
| 5,987,835 | A | | 11/1999 | Santarossa |
| 6,077,966 | A | | 6/2000 | Matsumura et al. |
| 6,105,325 | A | | 8/2000 | Zuber et al. |
| 6,106,607 | A | | 8/2000 | Be et al. |
| 6,165,261 | A | | 12/2000 | Wantling |
| 6,171,388 | B1 | | 1/2001 | Jobbins |
| 6,177,180 | B1 | | 1/2001 | Bodine et al. |
| 6,221,521 | B1 | | 4/2001 | Lynn et al. |
| 6,238,476 | B1 | | 5/2001 | Sprinkle |
| 6,268,042 | B1 | | 7/2001 | Baig |
| 6,663,979 | B2 | | 12/2003 | Deodhar et al. |
| 2002/0086114 | A1 | | 7/2002 | Madsen |
| 2003/0084633 | A1 | | 5/2003 | Zuber et al. |
| 2003/0085306 | A1 | | 5/2003 | John et al. |
| 2003/0113572 | A1 | | 6/2003 | Deodhar et al. |
| 2003/0153651 | A1 | | 8/2003 | Bonetto et al. |
| 2004/0154264 | A1 | | 8/2004 | Colbert |

FOREIGN PATENT DOCUMENTS

| | | | |
|---|---|---|---|
| DE | 142872 | A1 | 7/1980 |
| DE | 37 21 668 | A1 | 5/1989 |
| DE | 43 31 141 | | 3/1995 |
| EP | 0 496 682 | A1 | 7/1992 |
| EP | 0 521 804 | B1 | 7/1993 |
| FR | 2 505 908 | | 11/1982 |
| FR | 2 736 079 | A1 | 3/1997 |
| GB | 1 513 763 | | 6/1978 |
| JP | 60-065197 | | 4/1985 |
| JP | 09-109131 | | 4/1997 |
| WO | 97/02395 | A1 | 1/1997 |
| WO | 02/06183 | | 1/2002 |
| WO | 02/12144 | A2 | 2/2002 |
| WO | 02/058902 | A2 | 8/2002 |
| WO | 05/040475 | | 5/2005 |

OTHER PUBLICATIONS

"ACUMER® 9300—Dispersant for Paper and Paperboard Coatings", Rohm and Haas Company, Special Polymers.

George M. Kutcher, Jr., CDT, CSI, "Revisiting the Levels of Gypsum Board Finish", National Gypsum Company, pp. 1-3.

J.R. Gorman, et al., "Plaster and Drywall Systems Manual," BNI Books, Division of Building News, Inc., Apr. 12, 2003, pp. 240 and 251.

The White Book 1986 Edition, British Gypsum, Apr. 12, 2003.

The White Book, Plasterboard Fixing, Jointing and Decorating, British Gypsum, Apr. 12, 2003.

G.D. Plumb, M.A., Lightweight Partitions Having Improved Low Frequency Sound Insulations, Research and Development Department, 10 pages.

#9 White, Medium Calcium Carbonate Filler, Georgia Marble Company, May 1996.

Water Absorbency of Bibulous Papers, T 432 cm—99, Approved by the Physical Properties Committee of the Process and Product Quality Division.

Water Absorbency of Bibulous Papers, T 432 om—94, Approved by the Chemical Properties Committee of the Process and Product Quality Division.

Standard Conditioning and Testing Atmospheres for Paper, Board, Pulp Handsheets and Related Products, T 402 om—93, Approved by the Physical Properties Committee of the Process and Product Quality Division.

Gypsum Plasterboards, Mar. 1995, 30 pages.

Ken A. Phillips, et al., Industrial Minerals in Arizona's Wallboard Joint Cement Industry, Jul. 1989, 6 pages.

Ken Phillips, et al., Industrial Minerals in Southern California's Wallboard Joint Cement Industry, Sep. 1989, 6 pages.

Gypsum Plasterboard—Part 1: Specification for Plasterboard Excluding Material Submitted to Secondary Operations, 1985, 10 pages.

Dry Lining and Partitioning Using Gypsum Plasterboard, British Standard, 1995, 50 pages.

Sauli Rennes, et al., The Influence of Binders on the Structure and Water Sorption of Coated Paper, Apr. 12, 2003, pp. 698-703.

Technical Data, Calmote Ad, Omya UK.

Attagel 50, Engelhard.

Engelhard Material Safety Data Sheet, Lawrence Industries, Aug. 19, 1992.

Fordamin Stinnes Logistics, Fordacal S2 Talc.

Defoamers for Emulsion Paints and Emulsion Plasters, BYK Chemie, 4 pages.

4 Walocel M Delivery Programme.

Emultex 596, Synthomer International Technology Individual Service.

Sil-Cell 35/34, Silbrico Corporation, 2 pages.

Methocel Cellulose Ethers for Gypsum-Based Building Materials, How Methocel Cellulose Ethers Products Maximise the Performance of Gypsum-based Building Materials.

Elotex LIQ2020, Technical Data Sheet.

Twinstar Chemicals Limited, Benzoflex 9-88 Plasticiser Dipropyleneglycol Dibenzoate, 5 pages.

* cited by examiner

COATING SPRAY APPARATUS AND METHOD OF USING SAME

BACKGROUND OF THE INVENTION

1. Field of the Invention

The present invention relates to a manufacturing line for gypsum boards, and in particular to a coating spray apparatus and method of using for a manufacturing line for gypsum boards.

2. Discussion of Related Art

In a conventional gypsum board manufacturing process, a slurry of gypsum is sandwiched between two layers of facing sheets. After the gypsum core sets, the core, together with the facing sheets, is cut into board lengths. The cut boards are then sent through a dryer to substantially dry the gypsum core.

According to WO 02/12144, it is known to apply a coating to one side of the board. WO 02/058902 teaches applying a coating to a wet gypsum board prior to drying the gypsum board. In addition, U.S. Pat. No. 6,663,979 teaches applying a coating to a gypsum board either before or after drying of the board.

However, the gypsum board manufacturing line may be used for making different types of boards. Some of the boards may be coated with coating equipment as discussed above, and some boards may not be coated.

OBJECTS AND SUMMARY

Accordingly, it is an object of one embodiment of the present invention to provide a coating spray apparatus which can be pivoted from an operative position, wherein the spray apparatus is over the gypsum board manufacturing line to an inoperative position, wherein the spray apparatus is remote from the line and does not interfere with regular operations.

It is a further object of the present invention to provide a coating spray apparatus for a gypsum board manufacturing line that is able to apply the spray in a fine, easily controlled manner.

According to a first embodiment of the present invention, a manufacturing line for gypsum boards includes a conveyor for moving gypsum boards in a line; a spray arm having a pivot at one end thereof for supporting a spray arm in a pivotable manner; a base frame mounted adjacent the convey; a support for the pivot mounted on the base frame so that the spray arm can be pivoted from an operative position wherein the spray arm extends over the conveyor to an inoperative position; a plurality of spray nozzles arranged on the spray arm for spraying a coating on the gypsum boards on the conveyor; and a pump system on the base frame to deliver the coating to the plurality of spray nozzles.

According to another embodiment of the present invention, a spray arm for a manufacturing line for gypsum boards includes a support beam; a pivot at one end thereof for supporting the spray arm in a pivotable manner so that the spray arm can be pivoted at least about 90 degrees from an operative position to an inoperative position; and a plurality of spray nozzles arranged on the support beam for spraying a coating on gypsum boards, the plurality of nozzles arranged in clusters and the nozzles in each cluster are staggered so that at least some of the nozzles in each cluster are at different distances from the support beam with respect to each other.

According to another embodiment, a method according to the present invention of spraying a coating on a gypsum board on a gypsum board manufacturing line includes providing a spray arm having a plurality of nozzles attached thereto over the gypsum board manufacturing line; the plurality of nozzles are arranged in clusters and the nozzles in each cluster are staggered so that at least some of the nozzles in each cluster are at different distances from the spray arm with respect to each other, and the nozzles are further arranged such that the spray from each nozzle covers less than an entire width of the gypsum board on the line; emitting a coating from the spray nozzles such that a plurality of overlapping sprays are sprayed onto the gypsum board in succession; and wherein the nozzles are arranged such that a substantially uniform coating is applied to the board.

DETAILED DESCRIPTION OF THE PREFERRED EMBODIMENTS

FIGS. 1–8 illustrate a preferred embodiment of the present invention. The preferred embodiment includes an apparatus for spraying a coating onto gypsum boards, after the gypsum has set, but before the boards have been sent through a dryer. The coating is intended to provide a finish on the gypsum boards which facilitates providing a finished surface on the boards. In a preferred embodiment, the coating includes a mineral filler and is designed to match a joint compound used to finish joints between adjacent boards.

Figure 1:
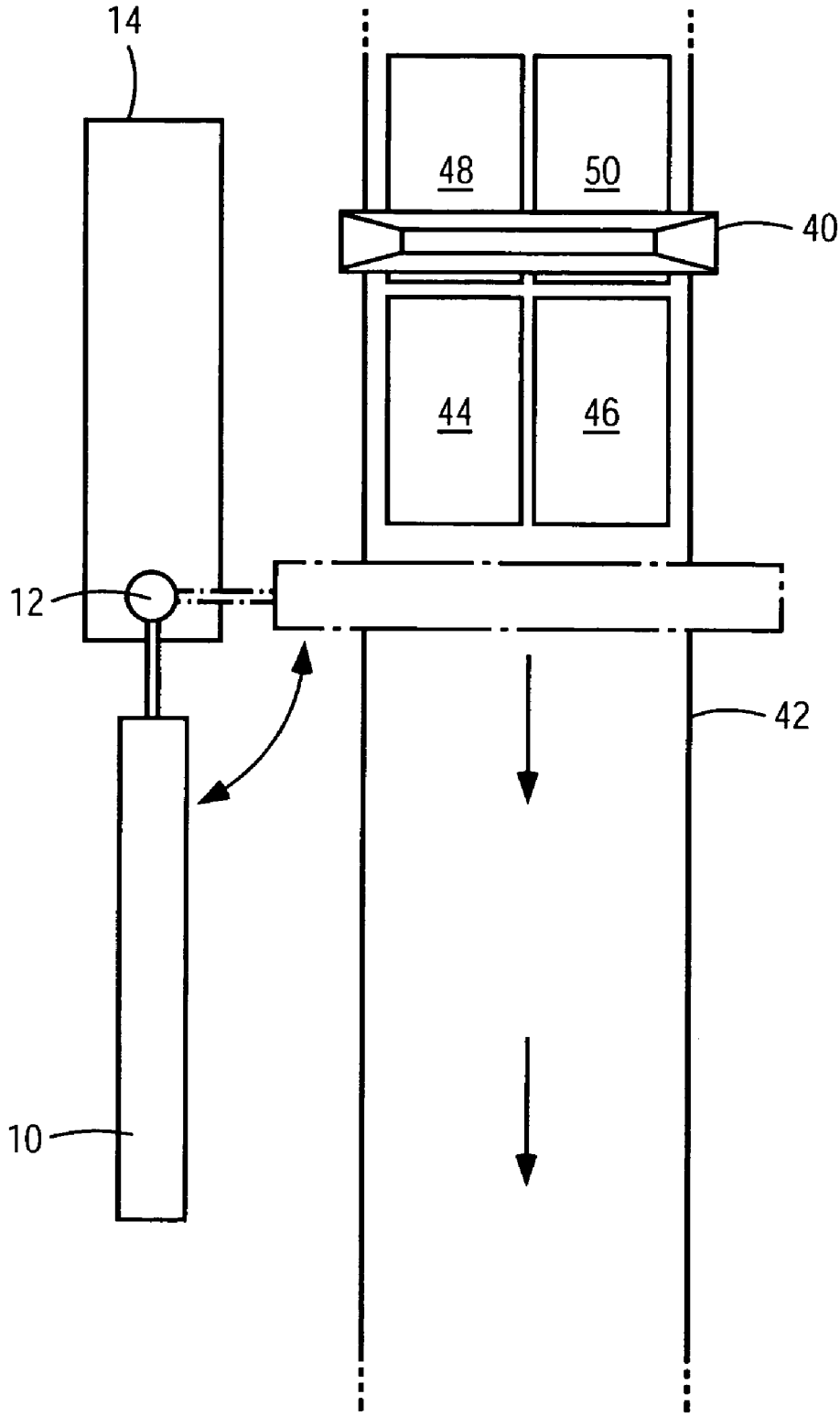
FIG. 1 discloses a schematic view of a portion of a gypsum board manufacturing line including an embodiment of the present invention.

Turning attention to FIG. 1, an overview of a portion of a line on which the gypsum boards are dried is shown, with the preferred embodiment of the present invention in place. The line includes a conveyor assembly 42 for conveying the set, but wet, gypsum boards 44, 46, 48, 50 through the dryer.

Figure 2:
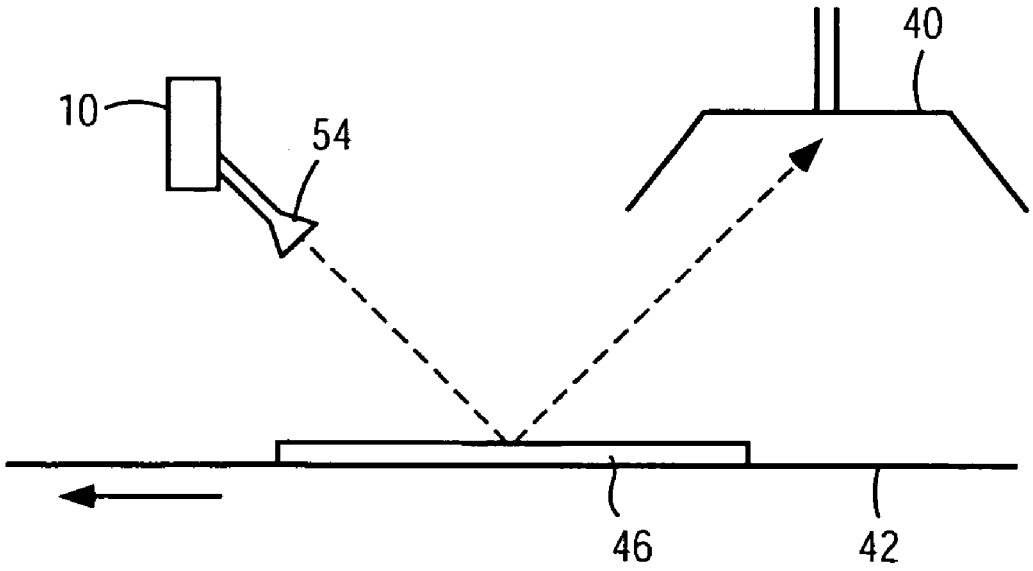
FIG. 2 discloses a side view of a portion of an embodiment of the present invention.

In this embodiment, a spray arm 10 of the present invention is arranged above the conveyor assembly 42, prior to the boards 44, 46, 48, 50 reaching the dryer. The spray arm 10 is mounted to a skid or frame 14 in a pivotable manner so that the spray arm 10 can be pivoted at least 90 to 180 degrees from an inoperative position illustrated in solid lines to an operative position illustrated in dashed lines. As best seen in FIG. 2, the spray arm 10 is arranged downstream of a hood 40, both of which are suspended above the conveyor 42. The spray arm 10 and the hood 40 are preferably arranged such that particles emitted from the spray arm 10 that reflect off of the boards 44, 46, 48 50 are picked up by the hood 40, which includes conventional exhaust and/or filtering equipment.

Figure 3:
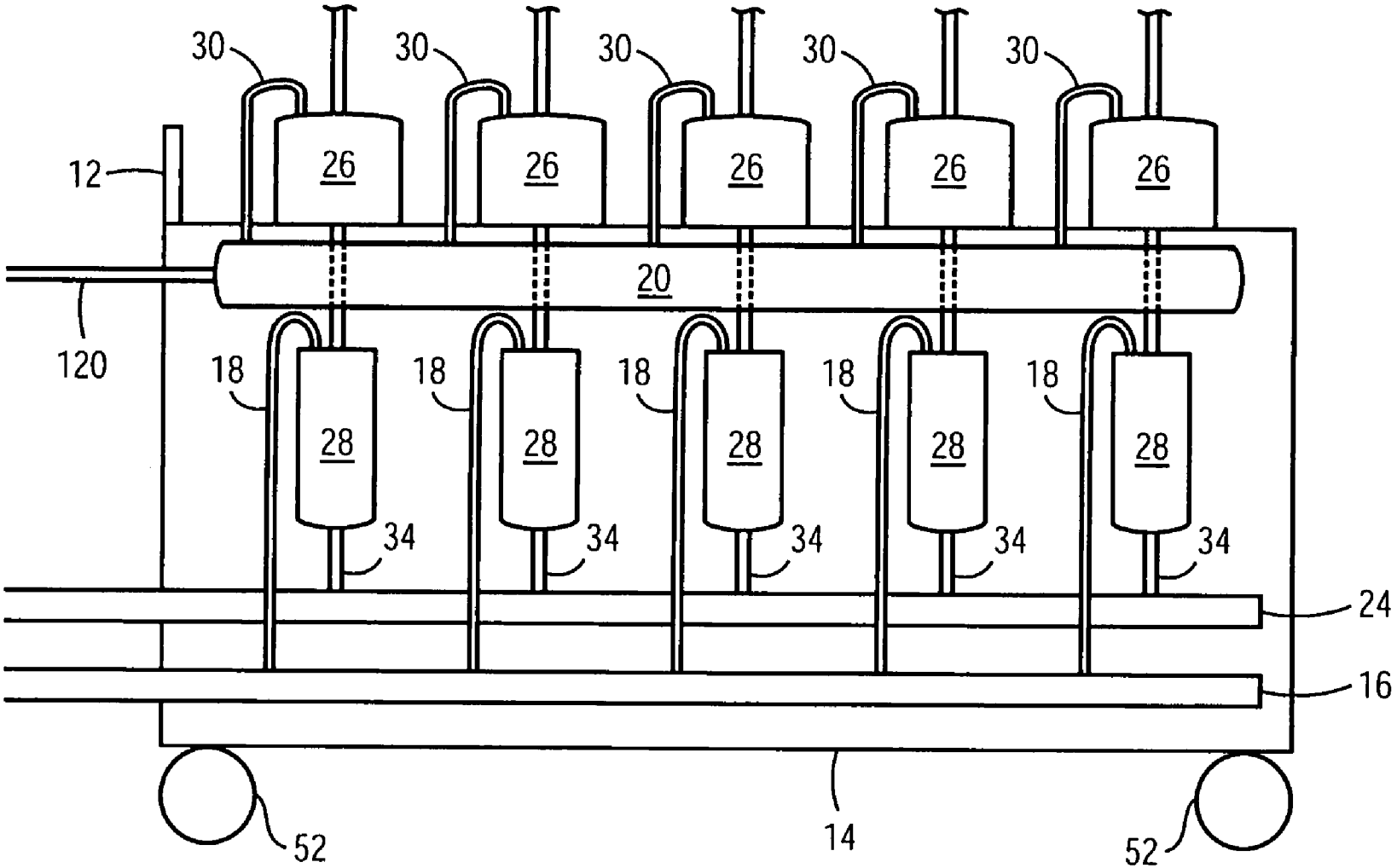
FIG. 3 is a side view of a pumping system in an embodiment of the present invention.

The coating apparatus includes several components. For example, the skid 14 (FIG. 3) is provided for supporting pumps and related equipment. As illustrated in FIG. 3, the skid 14 may be provided on wheels 52 so that the skid can be rolled into and out of place, as needed. At one end of the skid 14 is a pivot 12 which rotatably supports the spray arm 10 so that the spray arm 10 can be rotated into a working or operative position over the conveyor 42 or away from the conveyor 42, as illustrated in FIG. 1.

The skid 14 includes a plurality of pumps 28, each of which is driven by a respective pump motor 26. In the preferred embodiment, the pump motors 26 are air driven motors such that the speed of the output thereof can be controlled by the air pressure that is delivered to the pump motors 26. In the preferred embodiment, five pumps and pump motors are provided on the skid. However, only four are actually used for applying the coating. The fifth pump and pump motor are provided to serve as a back-up in the event that one of the four pumps fails. In a preferred embodiment, the pumps are manufactured by Graco.

A suction header 24 delivers a coating formula to each of the pumps 28 via respective hoses 34. The coating formula is delivered to the suction header 24 from pipe 80 (FIGS. 6 and 7) which is described in greater detail below. At the discharge end of each of the pumps 28, a hose 18 delivers the coating formula under high pressure to a spray feed header 16. In the preferred embodiment, the coating formula is output from the pumps at a pressure of about 2250 psi. The higher the pressure, the more coating formula is delivered to the boards. Thus, the delivery pressure of the coating formula may be varied depending upon the desired application. In general, the output pressure of the coating formula will typically be within the range of 1200 to 4500 psi. To achieve this range, the pump motors are supplied with air at a pressure of about 30–40 psi. However, the present invention is not limited to the pressure ranges set forth herein.

A control air manifold 20 is also present on the skid 14 adjacent the pump motors 26. Separate hoses 30 connect the control air manifold 20 to the respective pump motors 26 to provide the motive force for the pump motors 26.

Figure 4A:
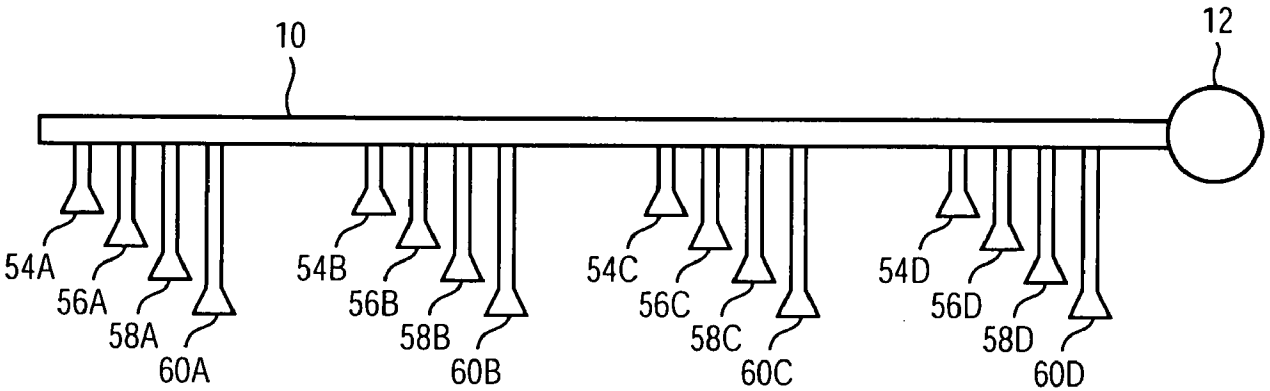
FIGS. 4A and 4B illustrate details of a spray arm of an embodiment of the present invention.
Figure 4B:
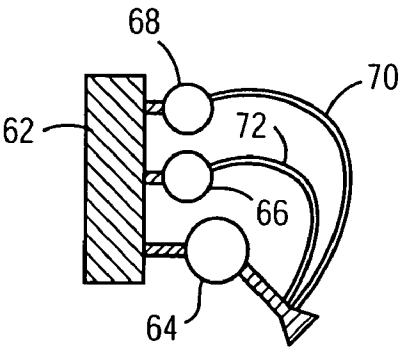

FIGS. 4A and 4B illustrate the spray arm 10. As can be seen at the right side of FIG. 4A, the spray arm 10 is connected to a pivot 12, which is fixed to the skid 14. The spray arm 10 includes a support beam 62 which supports sixteen nozzles (54A, 56A, 58A, 60A, 54B, 56B, 58B, 60B, 54C, 56C, 58C, 60C, 54D, 56D, 58D, 60D) and at least three conduits. A first conduit 64 delivers the high pressure coating formula from the spray feed header 16 to each of the nozzles 54, 56, 58, 60. A second conduit 66 delivers atomizing air to each of the nozzles 54, 56, 58, 60 via hoses 72 so that the coating formula can be uniformly sprayed onto the boards 44, 46, 48, 50. A third conduit 68, which is also attached to the support beam 62, delivers air under pressure through respective hoses 70 to control each of the nozzles 54, 56, 58, 60.

Figure 5:
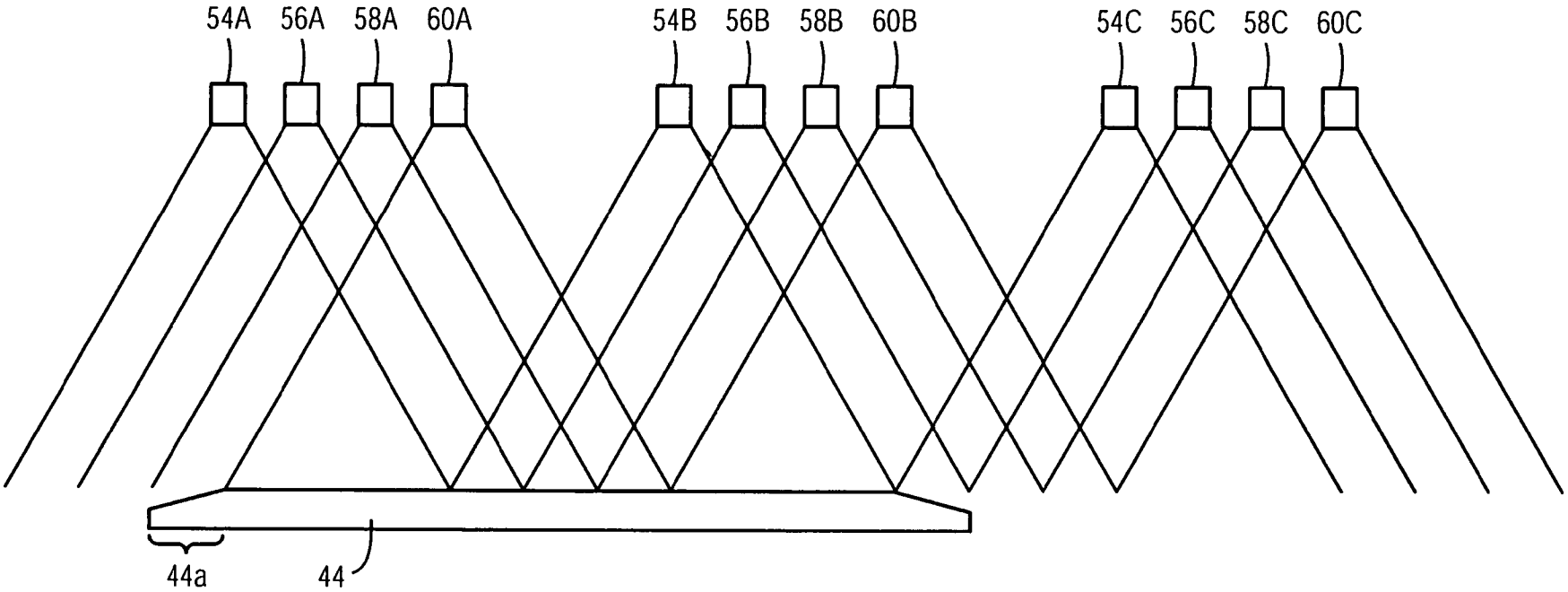
FIG. 5 illustrates the application of a plurality of layers of coating according to an embodiment of the present invention.

As can be best seen in FIGS. 4A and 5, the sixteen nozzles are arranged in four clusters of four nozzles in each cluster. The nozzles in each cluster are staggered such that the spray from nozzle 60A, for example, reaches the board prior to the spray from nozzle 58A, which reaches the board prior to the spray from nozzle 56A, and which reaches the board prior to that from nozzle 54A. As a result, the board receives essentially four layers of coating in short succession. By applying the coating in four successive layers, better control over the spray can be achieved. In the preferred embodiment, the layers are applied in such short order that the layers of coating formula essential commingle and become one uniform layer on the board. In other words, the layers do not form four separate layers on the board when dried. Although the preferred embodiment uses four clusters of four nozzles, the present invention could be practiced with other combinations of nozzles. Furthermore, it is also not necessary to use all of the nozzles provided on the support beam 62. For example, one or more nozzles in each cluster could be turned off.

FIG. 5 illustrates the overlapping nature of the spray from the nozzles. As can be seen in FIG. 5, the left margin 44*a* of the board 44 receives only three layers of coating, i.e., from nozzles 54A, 56A, and 58A. The spray from nozzle 60A does not reach the far left edge 44*a* of the board 44. However, the remaining portions of the board are coated with substantially four layers. In other words, the nozzles are arranged such that the spray from nozzle 54A does not substantially overlap with the spray from nozzle 54B, nor is there any significant spacing therebetween. Similarly, the spray from nozzle 56A does not overlap with the spray from nozzle 56B, nor is there any significant space therebetween, etc. By using this spacing with the nozzles, a substantially uniform coat from four nozzles is applied to each portion of the board, except for the left margin 44*a* of the board 44.

In a preferred embodiment, the nozzles or spray heads are manufactured by Graco. Various size nozzles have been tried, including #25, 27, 29, 31, 33, and 35. However, the #31 nozzle provides a spray with a width of about twelve inches, as it contacts the board, when the pump motor pressure is about 40 psi and the system pressure is about 2250 psi. At these parameters, about four gallons of coating per 1000 square feet is applied at the rate of about 2.25 gallons per minute. However, the present invention can be practiced with other combinations of nozzles, pressures, and spray widths.

Figure 6:
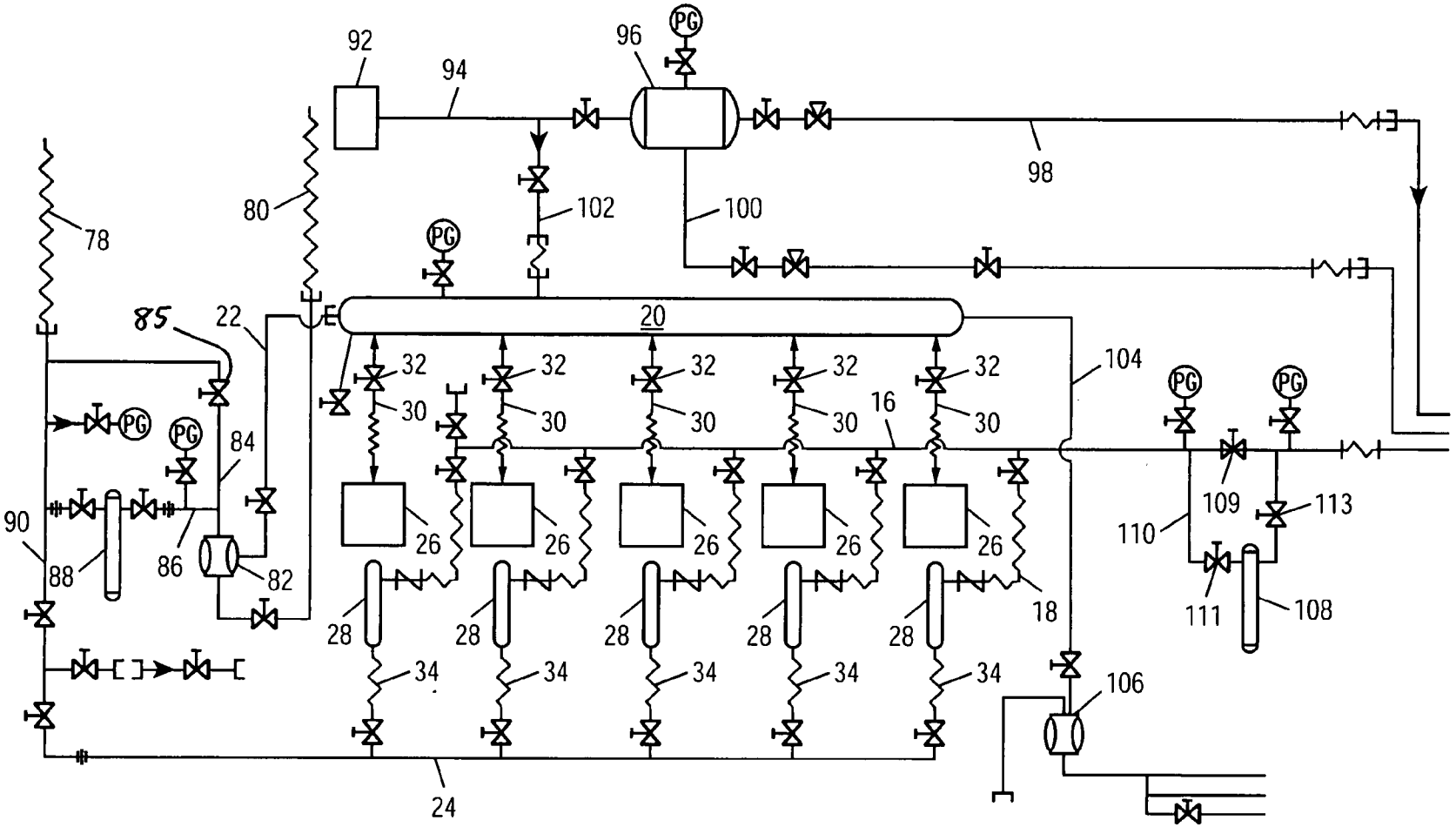
FIG. 6 illustrates a plumbing schematic of an embodiment of the present invention.

FIG. 6 illustrates a schematic "plumbing" diagram of the preferred embodiment of the present invention. Most of the components illustrated in FIG. 6 are arranged on the skid 14. For example, the control air manifold 20, the pump motors 26, the pumps 28, the spray feed header 16, and the suction header 24 are all located on the skid 14.

At the right side of FIG. 6 is illustrated a bypass circuit 110 which is connected to a filter 108. If desired, valve 109 can be closed and valves 111, 113 can be opened to divert the coating formula through the filter 108 prior to delivery to the nozzles 54, 56, 58, 60 on the spray arm 10.

Hose 80 delivers the coating formula from a storage tank 133 located off of the skid 14 to a low pressure pump 82, which pumps the coating formula to the suction header 24. The coating formula may be delivered directly to the suction header 24 through pipes 84 and 90. Alternatively, by the manipulation of the valve 85, pipe 84 may be shut off, and the coating formula may be delivered to pipe 90 through a filter 88 and pipe 86. Thus, by controlling the valves in and about the filter 88, the coating formula may be delivered either directly to the suction header 24 or may be filtered through filter 88 prior to delivery to the suction header 24. The pump 82 is driven by compressed air received from the control air manifold 20.

Figure 7:
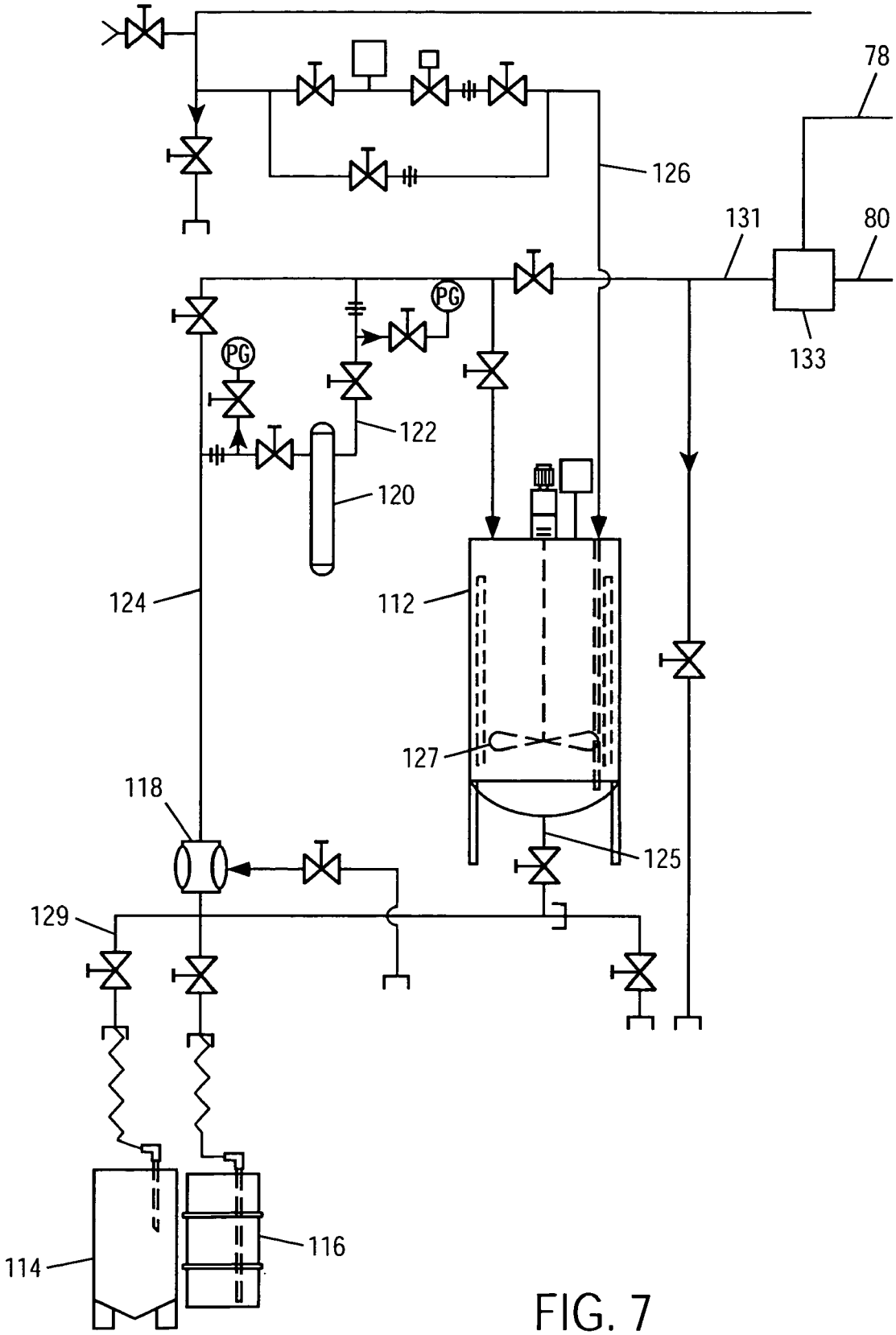
FIG. 7 illustrates another plumbing schematic of a different portion of the embodiment of FIG. 6.

Another hose 78 is connected to pipe 90 and can be used to deliver unused coating formula back to the storage tank 133, which is illustrated in FIG. 7.

At the top of FIG. 6 is illustrated a pump 92, which provides pressurized air to an atomizing air receiving tank 96 through pipe 94. Also extending from pipe 94 is a pipe 102 which delivers pressurized air to the control air manifold 20. Preferably, the pump 92 maintains the pressure in the control air manifold at approximately 100 psi. From the atomizing air receiving tank 96, a pipe 98 delivers atomizing air to the atomizing air delivery pipe 66, which is connected to the support beam 62 of the spray arm 10. See FIG. 4B. In addition, a pipe 100 connects the atomizing air receiving tank 96 to the control air delivery pipe 68, which is also mounted to the support beam 62 of the spray arm 10.

The control air from the control air delivery pipe 68 is used to turn the nozzles 54, 56, 58, 60 on and off. The air is controlled by a solenoid (not illustrated). The solenoid is controlled by a timer that is coordinated with the drive mechanism for rollers associated with the conveyor 42. Preferably, the timer controls the solenoid and nozzles such that the coating is only sprayed from the nozzles while there is a board below the nozzles, so as to avoid wasting the coating. However, during normal continuous runs, the pumps 28 continue to operate and pressure is maintained in the conduit 64 even when the nozzles are turned off between boards.

The nozzles 54, 56, 58, 60 are air-actuated spray heads. When pressurized air is delivered by the conduit 68 to the nozzles, the nozzles are opened allowing the coating formula and atomizing air to flow through the nozzles. When the pressure in the conduit 68 is dropped, e.g., to atmospheric pressure, the nozzles are closed.

Figure 8:
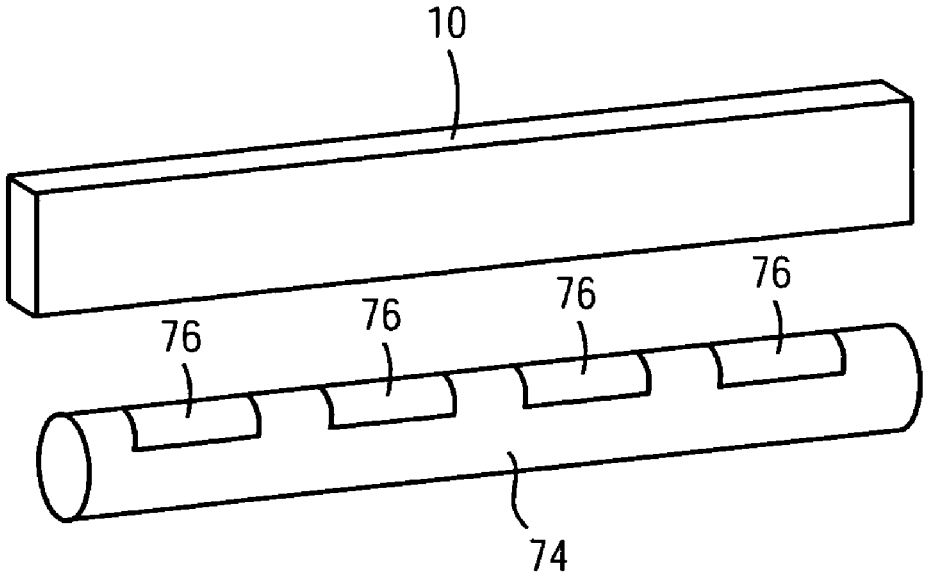
FIG. 8 illustrates yet another portion of an embodiment of the present invention.

In the lower right corner of FIG. 6 is illustrated a double diaphragm pump 106 which is used to clean out a drip/overspray pan 74, which is illustrated in FIG. 8, and described later herein.

FIG. 7 illustrates a storage tank 112. The storage tank 112 is filled with the coating formula by a pipe 126 that is connectable to a tanker truck. Alternatively the tank 112 can be filled with the coating formula delivered in drums or barrels 114. A tank 116 is also provided for clean-out.

The coating formula in the tank 112 may be circulated or stirred by a propellor blade 127 located within the tank 112. In addition, a drain 125 at the bottom of the tank can be used to recirculate the coating formula by means of a pump 118 and plumbing 124 so that the coating formula can be removed from the bottom of the tank 112 and redelivered to the top of the tank 112 to recirculate or stir the coating formula.

In addition, bypass plumbing 122 can be provided so that the coating formula can be bypassed through a filter 120 during the recirculation process so that the coating formula may be filtered, while it is being recirculated. In addition, pipe 129 can be used to drain off or remove coating formula from the system.

Pipe 131, which is connected to the pump 118 via plumbing 124, is used to deliver the coating formula from the tank 112 to an intermediate tank 133 illustrated schematically. The intermediate tank 133 can be located adjacent the skid 14, or in any convenient location, preferably near the skid.

During the operation of the spray apparatus, the operating pressure from the air control manifold 20 to the pump motors 26 is preferably in the range of 30–40 psi. However, higher or lower pressures may be used, as desired.

Because the spray arm 10 is connected to the skid 14 with a pivot 12, the spray arm 10 can be moved into position over the board conveyor 42, or can be pivoted so that it is no longer over the board conveyor 42.

In addition, as set forth above, the skid 14 can be mounted on wheels 52. However, in an alternative embodiment, the skid 14 may be permanently fixed to the plant floor.

As illustrated in FIG. 8, a drip/overspray pan 74 is provided with four cutouts 76. The drip/overspray pan 74 and cutouts 76 are arranged such that the drip/overspray pan 74 can be secured to the support beam 62 of the spray arm 10 so that the drip/overspray pan 74 is located with the cutouts 76 in alignment with the four clusters of nozzles. The drip/overspray pan 74 can be used for rinsing or flushing the nozzles 54, 56, 58, 60 with water.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A manufacturing line for gypsum boards, the manufacturing line comprising:

a conveyor for moving gypsum boards in a line;

a spray arm having a pivot at one end thereof for supporting the spray arm in a pivotable manner;

a base frame mounted adjacent the conveyor;

a support for the pivot mounted on the base frame so that the spray arm can be pivoted from an operative position wherein the spray arm extends over the conveyor to an inoperative position;

a plurality of spray nozzles arranged on the spray arm for spraying a coating on gypsum boards on the conveyor; and a pump system on the frame to deliver the coating to the plurality of spray nozzles;

wherein the plurality of nozzles are arranged in clusters and the nozzles in each cluster are staggered so that at least some of the nozzles in each cluster are at different distances from the spray arm with respect to each other.

2. The manufacturing line of claim 1, wherein the spray arm is not over the conveyor when the spray arm is in the inoperative position.

3. The manufacturing line of claim 1, wherein when the spray arm is in the operative position, the spray arm is upstream of a dryer for the manufacturing line.

4. The manufacturing line of claim 1, further comprising a tank for holding the coating prior to spraying on the gypsum boards.

5. The manufacturing line of claim 1, further comprising a controller for turning the spray on only when a board is below the nozzles.

6. The manufacturing line of claim 5, wherein the controller is activated by a timer to control the spray.

7. The manufacturing line of claim 5, wherein the nozzles are activating by pressurized air.

8. The manufacturing line of claim 1, further comprising one or more filters for filtering the coating prior to delivery of the coating to the nozzles.

9. The manufacturing line of claim 1, wherein the base frame is mounted on wheels so that the base frame can be moved to a remote location.

10. The manufacturing line of claim 1, wherein the pump system includes a plurality of pumps arranged in parallel.

11. The manufacturing line of claim 1, wherein the coating is includes a mineral filler.

12. The manufacturing line of claim 1, further comprising means for delivering atomizing air to the nozzles.

13. A spray arm for a manufacturing line for gypsum boards, the spray arm comprising:

a support beam;

a pivot at one end thereof for supporting the spray arm in a pivotable manner so that the spray arm can be pivoted at least about 90 degrees from an operative position to an inoperative position; and a plurality of spray nozzles arranged on the support beam for spraying a coating on gypsum boards, the plurality of nozzles arranged in clusters and the nozzles in each cluster are staggered so that at least some of the nozzles in each cluster are at different distances from the support beam with respect to each other.

14. The spray arm of claim 13, further comprising a controller for spraying the coating only when a board is below the nozzles.

15. The spray arm of claim 14, wherein the controller is activated by a timer to control the spray.

16. The spray arm of claim 14, wherein the nozzles are activating by pressurized air.

17. The spray arm of claim 13, further comprising one or more filters for filtering the coating prior to delivery of the coating to the nozzles.

18. The spray arm of claim 13, wherein the coating is includes a mineral filler.

19. The spray arm of claim 13, further comprising means for delivering atomizing air to the nozzles.

20. A method of spraying a coating on a gypsum board on a gypsum board manufacturing line, the method comprising:

providing a spray arm having a plurality of nozzles attached thereto over the gypsum board manufacturing line;

the plurality of nozzles are arranged in clusters and the nozzles in each cluster are staggered so that at least some of the nozzles in each cluster are at different distances from the spray arm with respect to each other, and the nozzles are further arranged such that the spray from each nozzle covers less than an entire width of the gypsum board on the line;

emitting a coating from the spray nozzles such that a plurality of overlapping sprays are sprayed onto the gypsum board in succession; and wherein the nozzles are arranged such that a substantially uniform coating is applied to the board.

21. The method of claim 20, wherein the coating is applied to the gypsum before the board goes through a dryer.

22. The method of claim 20, wherein a timer is used to turn the spray on and off so that the spray is only emitted when a gypsum board is below the nozzles.

23. The method of claim 20, wherein the spray arm is pivotally mounted, and further comprising the step of pivoting the spray arm away from the manufacturing line after coating the gypsum board.

24. The manufacturing line of claim 1, wherein adjacent nozzles in each of the clusters are spaced from each other at a distance that is less than a distance between each cluster.

25. The spray arm of claim 13, wherein adjacent nozzles in each of the clusters are spaced from each other at a distance that is less than a distance between each cluster.

26. The method of claim 20, wherein adjacent nozzles in each of the clusters are spaced from each other at a distance that is less than a distance between each cluster.

27. A manufacturing line for gypsum boards, the manufacturing line comprising:

a conveyor for moving gypsum boards in a line;

a spray arm; and a plurality of spray nozzles arranged on the spray arm for spraying a coating on gypsum boards on the conveyor, wherein the plurality of nozzles are arranged in clusters and the nozzles in each cluster are staggered so that at least some of the nozzles in each cluster are at different distances from the spray arm with respect to each other.

28. The manufacturing line of claim 27, wherein adjacent nozzles in each of the clusters are spaced from each other at a distance that is less than a distance between each cluster.

* * * * *